US011338356B2

(12) United States Patent
Díaz Fernández et al.

(10) Patent No.: US 11,338,356 B2
(45) Date of Patent: May 24, 2022

(54) AMINO ACID-CONTAINING MOULDING MATERIAL MIXTURE FOR PRODUCTION OF MOULDINGS FOR THE FOUNDRY INDUSTRY

(71) Applicant: HÜTTENES-ALBERTUS CHEMISCHE WERKE GESELLSCHAFT MIT BESCHRÄNKTER HAFTUNG, Düsseldorf (DE)

(72) Inventors: Jaime Díaz Fernández, Vizcaya (ES); Wolfgang Seelbach, Korschenbroich (DE)

(73) Assignee: HÜTTENES-ALBERTUS CHEMISCHE WERKE GESELLSCHAFT MIT BESCHRÄNKTER HAFTUNG, Düsseldorf (DE)

( * ) Notice: Subject to any disclaimer, the term of this patent is extended or adjusted under 35 U.S.C. 154(b) by 299 days.

(21) Appl. No.: 16/464,859

(22) PCT Filed: Nov. 28, 2017

(86) PCT No.: PCT/EP2017/080602

§ 371 (c)(1),
(2) Date: May 29, 2019

(87) PCT Pub. No.: WO2018/099887

PCT Pub. Date: Jun. 7, 2018

(65) Prior Publication Data

US 2019/0283116 A1 Sep. 19, 2019

(30) Foreign Application Priority Data

Nov. 29, 2016 (DE) ..... 10 2016 123 051.0

(51) Int. Cl.
*B22C 1/22* (2006.01)

(52) U.S. Cl.
CPC ..... *B22C 1/224* (2013.01); *B22C 1/2246* (2013.01); *B22C 1/2253* (2013.01)

(58) Field of Classification Search
CPC ..... B22C 1/2246; B22C 1/2253
See application file for complete search history.

(56) References Cited

U.S. PATENT DOCUMENTS

| | | | | |
|---|---|---|---|---|
| 3,296,666 | A | 1/1967 | Lirones | |
| 3,644,274 | A | 2/1972 | Maurukas | |
| 3,725,333 | A * | 4/1973 | Adkins | B22C 1/224 523/144 |
| 3,806,491 | A | 4/1974 | Gardikes et al. | |
| 5,320,157 | A | 6/1994 | Siak et al. | |
| 5,941,180 | A | 8/1999 | Becker | |
| 6,391,942 | B1 | 5/2002 | Chang | |
| 2006/0119018 | A1 | 6/2006 | Watanabe | |
| 2013/0232884 | A1 | 9/2013 | Tumler | |
| 2014/0048740 | A1 | 2/2014 | Fourberg | |
| 2016/0158828 | A1 | 6/2016 | Tanaka | |

FOREIGN PATENT DOCUMENTS

| | | |
|---|---|---|
| CN | 1088494 | 6/1994 |
| CN | 101475676 | 7/2009 |
| CN | 105081198 | 11/2015 |
| CN | 105414449 | 3/2016 |
| CN | 106040960 | 10/2016 |
| DE | 2353642 | 5/1975 |
| DE | 19856778 | 6/1999 |
| DE | 60005574 | 8/2004 |
| EP | 0540837 | 5/1993 |
| EP | 1531018 | 5/2005 |
| EP | 1595618 | 11/2005 |
| GB | 1075619 | 12/1964 |
| JP | S4814288 | 5/1973 |
| JP | 06292938 | 10/1994 |
| JP | 10193033 A * | 7/1998 |
| JP | H10193033 | 7/1998 |
| JP | 2001347339 | 12/2001 |
| WO | 199719141 | 5/1997 |

OTHER PUBLICATIONS

Machine translation of JP 10-193033 A, published Jul. 28, 1998.*
Machine translation of 23 53 642 A1, published May 7, 1975.*
Xijin, Liu, "Foundry Technology," China Machine Press, 1999, pp. 5-7, 9-10, 57-64.
Lin, B., et al., "Sand Casting Technology," Beijing China Machine Press, Oct. 1990, pp. 78-80.

* cited by examiner

*Primary Examiner* — Nickey Nerangis
(74) *Attorney, Agent, or Firm* — Duane Morris LLP; Gregory M. Lefkowitz; Brandon A. Chan

(57) ABSTRACT

The present invention relates to a mold material mixture for producing moldings for the foundry industry, in particular for producing foundry molds, cores or feeders for the foundry industry, which comprises A) one or more pourable, refractory fillers, B) a binder system comprising i) formaldehyde, a formaldehyde donor and/or precondensates of formaldehyde and ii) an amino acid. The present invention additionally relates to the use of amino acids in a mold material mixture for producing moldings for the foundry industry or for producing moldings for the foundry industry, a process for producing a mold material mixture and a process for producing a molding for the foundry industry.

17 Claims, No Drawings

AMINO ACID-CONTAINING MOULDING MATERIAL MIXTURE FOR PRODUCTION OF MOULDINGS FOR THE FOUNDRY INDUSTRY

CROSS-REFERENCE TO RELATED APPLICATIONS

This application is a § 371 national stage entry of International Application No. PCT/EP2017/080602, filed on Nov. 28, 2017, which claims priority to German Patent Application No. 10 2016 123 051.0, filed on Nov. 29, 2016, the entire contents of which are incorporated herein by reference.

The present invention relates to a mold material mixture for producing moldings for the foundry industry, moldings for the foundry industry, use of amino acids in a mold material mixture for producing moldings for the foundry industry or for producing moldings for the foundry industry, a process for producing a mold material mixture and a process for producing a molding for the foundry industry.

In the foundry industry, molten materials, ferrous metals or non-ferrous metals are converted into shaped objects having particular workpiece properties. For shaping the castings, sometimes very complicated casting molds for accommodating the metal melt firstly have to be produced. The casting molds are subdivided into non-permanent molds which are destroyed after each casting operation and permanent molds by means of which a large number of castings can be produced in each case. The non-permanent molds usually consist of a refractory, pourable mold material which is solidified by means of a curable binder.

Molds are negatives which contain the hollow space which is to be filled in the casting operation so as to give the casting which is to be produced. In producing the mold, the hollow space is formed in the mold material by means of a model of the casting to be produced. Internal contours are represented by cores which are made in a separate core box.

Both organic and inorganic binders, whose curing can be effected by cold or hot processes, can be used for producing the casting molds. A cold process here is a process in which the curing is effected essentially at room temperature without heating of the mold material mixture. Curing here usually occurs by means of a chemical reaction which can, for example, be triggered by a gaseous catalyst being passed through the mold material mixture to be cured or by a liquid catalyst being added to the mold material mixture. In the case of hot processes, the mold material mixture is, after shaping, heated to a sufficiently high temperature for, for example, driving off the solvent present in the binder or for initiating a chemical reaction by means of which the binder is cured by crosslinking.

The production of the casting molds can be carried out here by the filler firstly being mixed with the binder system so that the grains of the refractory filler are coated with a thin film of the binder system. The mold material mixture obtained from filler and binder system can then be introduced into an appropriate mold and optionally compacted in order to achieve sufficient strength of the casting mold. The casting mold is subsequently cured. When the casting mold has achieved at least a certain initial strength, it can be taken from the mold.

At present, organic binders such as polyurethane resins, furan resins, phenolic resins or urea-formaldehyde resins, in the case of which curing of the binder is effected by addition of a catalyst, are frequently used for producing casting molds.

Processes in which the curing of the mold material mixture is carried out by means of heat or by subsequent addition of a catalyst have the advantage that the processing of the mold material mixture is not subject to any particular restrictions in terms of time. The mold material mixture can firstly be produced in relatively large amounts which are then processed within a relatively long period of time, usually a number of hours. The curing of the mold material mixture occurs only after shaping, with a rapid reaction being sought. The casting mold can be taken from the molding tool immediately after curing, so that short cycle times can be realized.

In the production of casting molds for large castings, for example engine blocks of ships' diesels or large machine parts such as hubs of rotors for wind power stations, "no-bake binders" are mostly used. In the "no-bake process", the refractory base mold material (e.g. sand) is frequently firstly coated with a catalyst (hardener), the binder is subsequently added and uniformly distributed by mixing over the previously catalyst-coated grains of the refractory base mold material. In this process, continuous through-flow mixers are frequently employed. The resulting mold material mixture can then be shaped to give a molding. Since binder and catalyst are uniformly distributed in the mold material mixture, curing occurs largely uniformly even in the case of large moldings.

As an alternative, the refractory base mold material (e.g. sand) can firstly be mixed with the binder and the hardener can subsequently be added in the "no-bake process". In this process variant, partial curing or crosslinking of the binder, which would result in an inhomogeneous mold material, can occur, in particular in the production of casting molds for large castings, because of a partial, locally excessive concentration of the hardener.

The "classical" no-bake binders are frequently based on furan resins or phenolic resins or furan/phenol resins. They are often marketed as systems (kits) in which one component comprises a reactive furan resin or phenolic resin or furan/phenol resin and the other component comprises an acid, with the acid acting as catalyst for curing of the reactive resin component.

Furan resins and phenolic resins display very good disintegration properties on casting. The furan resin or phenolic resin decomposes under the action of the heat of the liquid metal and the strength of the casting mold is lost. After casting, cores can therefore be removed from hollow spaces, optionally after prior shaking of the casting.

"Furan no-bake binders" contain reactive furan resins which normally comprise furfuryl alcohol as main component. Furfuryl alcohol can react with itself in the presence of acid catalysis and form a homopolymer. For the production of furan no-bake binders, furfuryl alcohol is generally not used alone, but instead further compounds such as formaldehyde which are polymerized into the resin are added to the furfuryl alcohol. Further components which influence the properties of the resin, for example its elasticity, can also be added to the resins. For example, melamine and urea can be added in order to bind any free formaldehyde.

Furan no-bake binders are usually prepared by firstly producing precondensates of, for example, urea, formaldehyde and furfuryl alcohol under acidic conditions. These precondensates are then diluted with furfuryl alcohol.

It is likewise conceivable for urea and formaldehyde alone to be reacted. This forms UF resins ("urea formaldehyde" resins, "amino plastics"). These are usually subsequently diluted with furfuryl alcohol. Advantages of this method of production are high flexibility/variability in the product range and low costs since the processes are cold mixing processes.

Resols can also be used for producing furan/phenol no-bake binders. Resols are produced by polymerization of mixtures of phenol and formaldehyde. These resols are then frequently diluted with a large amount of furfuryl alcohol.

Furan no-bake binders are cured by means of an acid. This acid catalyzes the crosslinking of the reactive furan resin. It should be noted that curing can be controlled via the amount of acid, with the amount of acid needed to set a particular curing time being dependent on the binder and being influenced by factors such as the pH of the binder and the type of acid.

Aromatic sulfonic acids, phosphoric acid, methanesulfonic acid and sulfuric acid are frequently used as acids. In some specific cases, combinations of these are used, sometimes also in combination with further carboxylic acids. Furthermore, particular "curing moderators" can be added to the furan no-bake binder.

Phenolic resins as second large group of acid-catalyzed curable no-bake binders contain, as reactive resin component, resols, i.e. phenolic resins, which have been prepared using a molar excess of formaldehyde. In comparison with furan resins, phenolic resins display a lower reactivity and require strong sulfonic acids as catalysts.

No-bake binders have for some time been used for the manufacture of molds and cores for large-scale and single casting. These cold-curing systems are usually reaction products of formaldehyde with furfuryl alcohol, phenol and/or urea.

Mold material mixtures based on formaldehyde usually have very good properties. Phenol/furan/formaldehyde mixed resins, urea/formaldehyde resins and furan/formaldehyde resins, in particular, are frequently used in the foundry industry.

U.S. Pat. No. 3,644,274 relates primarily to a no-bake process using particular mixtures of acid catalysts for curing furfuryl alcohol-formaldehyde-urea resins.

U.S. Pat. No. 3,806,491 relates to binders which can be used in the "no-bake" process. The binders used there comprise products of the reaction of paraformaldehyde with particular ketones in a basic medium and also furfuryl alcohol and/or furan resins.

U.S. Pat. No. 5,491,180 describes resin binders which are suitable for use in the no-bake process. The binders used there are based on 2,5-bis(hydroxymethyl)furan or methyl or ethyl ethers of 2,5-bis(hydroxymethyl)furan, with the binders containing from 0.5 to 30% by weight of water and usually a high proportion of furfuryl alcohol.

EP 0 540 837 proposes low-emission, cold-curing binders based on furan resins and lignin from the organosolv process. The furan resins described there contain a high proportion of monomeric furfuryl alcohol.

DE 198 56 778 describes cold resin binders which are produced by reaction of an aldehyde component, a ketone component and a component consisting essentially of furfuryl alcohol.

EP 1 531 018 relates to no-bake foundry binder systems composed of a furan resin and particular acid hardeners. The binder systems described therein preferably comprise from 60 to 80% by weight of furfuryl alcohol.

US 2016/0 158 828 A1 describes the production of casting molds by means a rapid prototyping process. The mold material mixtures described in the document can contain A) at least one refractory filler and B) a binder system, where the binder system can contain i) formaldehyde and ii) a thermoset resin, a saccharide, a synthetic polymer, a salt, a protein or an inorganic polymer.

EP 1 595 618 B1 describes a process for producing a ceramic mask mold. A casting slip which contains ceramic particles, a binder and a fluidizer is used for producing the mold. The fluidizer can comprise amino acids, ammonium polyacrylates or three-acid carboxyls having alcohol groups.

DE 600 05 574 T2 relates to a process for producing thermal insulation bodies. The thermal insulation bodies described in the document comprise mineral wool and a binder based on a formaldehyde-phenol resin.

U.S. Pat. No. 3,296,666 A describes a process for producing casting molds. In the document, synthetic resin materials, natural resins, rubber, proteins, carbohydrates or egg whites are used as alternative binders to phenol-formaldehyde resins.

U.S. Pat. No. 5,320,157 A describes a process for producing a core, where the mold material mixture used for producing the core contains gelatin as binder.

In the production of moldings (e.g. feeders, foundry molds or cores) for the foundry industry, it is advantageous for the binder system to have a high strength after curing. Good strengths are particularly important for production of complicated, thin-walled moldings and for handling them safely.

It was therefore an object of the present invention to provide a mold material mixture which can be used for producing moldings for the foundry industry and which has an improved strength.

This object was achieved according to the invention by a mold material mixture for producing moldings for the foundry industry, which comprises A) one or more pourable, refractory fillers, and B) a binder system comprising i) formaldehyde, a formaldehyde donor and/or precondensates of formaldehyde, and ii) an amino acid.

It has surprisingly been found that moldings for the foundry industry have an improved strength when they are produced from a mold material mixture according to the invention. The addition of an amino acid to a binder system comprising formaldehyde, a formaldehyde donor and/or precondensates of formaldehyde in this case surprisingly improved the strength of the molding produced therefrom, compared to moldings which were produced under identical conditions from mold material mixtures having the same composition but without the addition of an amino acid.

It has also surprisingly been found that moldings produced from a mold material mixture according to the invention additionally have a lower content of free formaldehyde. Formaldehyde has a pungent odor and is toxic in high concentrations. It is therefore advantageous for moldings to have less free formaldehyde and for no formaldehyde to be released into the surroundings. Particularly when many moldings are stored in a confined space, there is otherwise the risk of the maximum workplace concentration (MWC) for formaldehyde being exceeded. The emission of formaldehyde from a mold material mixture according to the invention before and during curing can surprisingly also be reduced by the addition of amino acids.

In order to reduce the content of free formaldehyde in mold material mixtures or in moldings produced from the mold material mixtures, there was naturally also the possibility of adding less formaldehyde, formaldehyde donor and/or precondensates of formaldehyde to the binder system. However, this would lead to a significant deterioration in the properties (in particular the strength) of the moldings produced from the mold material mixtures.

In order to reduce the concentration of free formaldehyde in mold material mixtures or in moldings produced from the mold material mixtures, urea has hitherto customarily been used as formaldehyde scavenger. However, compared to urea, amino acids additionally have the advantage that the nitrogen content in the mold material mixture or in the moldings produced therefrom can be reduced, since the amino acids according to the invention are the more effective formaldehyde scavengers. In addition, no significant improvement but rather a reduction in the strength is to be observed when using urea. In addition, reaction products which are not stable in the mixture and lead to turbidity and precipitates are not infrequently formed when using urea as formaldehyde scavenger.

Particularly in iron and steel casting, especially in stainless steel casting, a very low total nitrogen content is desirable since nitrogen can lead to casting defects. For use in the field of steel casting and also grey cast iron casting, a binder should have a very low total nitrogen content since surface defects, for example "pinholes", occur as casting defects due to a high nitrogen content.

According to the invention, the moldings for the foundry industry are preferably feeders, foundry molds or cores for the foundry industry.

As pourable, refractory fillers, it is possible to use all particulate fillers which are customarily used for producing moldings (in particular feeders, foundry molds and cores) for the foundry industry, e.g. silica sand and specialty sands. The expression specialty sand encompasses natural mineral sands and also sintered and fused products which are produced in particulate form or are converted into particulate form by crushing, milling and classification operations or inorganic mineral sands formed by means of other physicochemical processes, which are used as base mold materials together with customary foundry binders for the manufacture of feeders, cores and molds.

In a preferred embodiment of the present invention, particular preference is given to a mold material mixture according to the invention in which the one, at least one of the several or all pourable, refractory fillers are selected from the group consisting of silica sand, fused silica sand, olivine sand, chrome-magnesite granules, aluminum silicates, in particular J-sand and kerphalites, heavy minerals, in particular chromite, zircon sand and R-sand, industrial ceramics, in particular Cerabeads, chamotte, M-sand, Alodur, bauxite sand and silicon carbide, feldspar-containing sands, andalusite sands, hollow $\alpha$-alumina spheres, spheres composed of fly ashes, rice hull ashes, expanded glasses, foamed glasses, expanded perlites, core-shell particles, hollow microspheres, fly ashes and further specialty sands.

Preference is given according to the invention to mold material mixtures in which the one, at least one of the several or all pourable, refractory fillers have an average particle diameter d50 in the range from 0.001 to 5 mm, preferably in the range from 0.01 to 3 mm, particularly preferably in the range from 0.02 to 2.0 mm. The average particle diameter d50 is determined in accordance with DIN 66165-2, F and DIN ISO 3310-1.

Preference is likewise given according to the invention to mold material mixtures in which the ratio of the total mass of pourable, refractory fillers to the total mass of other constituents of the mold material mixture is in the range from 100:5 to 100:0.1, preferably from 100:3 to 100:0.4, particularly preferably from 100:2 to 100:0.6.

Preference is likewise given to mold material mixtures according to the invention in which the bulk density of a mixture of all solids of the mold material mixture is 100 g/I or greater, preferably 200 g/I or greater, particularly preferably 1000 g/I or greater.

Preference is given according to the invention to mold material mixtures in which the binder system additionally comprises:

(a) phenols, in particular phenol, o-cresol, p-cresol, 3,5-xylenol or resorcinol, or precondensates of phenols, in particular resols, (b) furan derivatives and/or furfuryl alcohol or precondensates of furan derivatives and/or furfuryl alcohol and/or (c) urea or urea derivatives or precondensates of urea or urea derivatives.

In a preferred embodiment of the present mold material mixture of the invention, the binder system is, during production of the moldings, admixed with a hardener which initiates the curing of the binder. The hardener is usually an acid, preferably at least one organic or inorganic acid, particularly preferably an aromatic sulfonic acid (in particular para-toluenesulfonic and/or xylenesulfonic acid), phosphoric acid, methanesulfonic acid, sulfuric acid, one or more carboxylic acids or mixtures thereof.

In an alternative preferred embodiment, particular preference is given to mold material mixtures according to the invention in which the binder system is thermally curable.

Particular preference is given to mold material mixtures according to the invention in which the binder additionally comprises (a) phenols, in particular phenol, o-cresol, p-cresol, 3,5-xylenol or resorcinol, or precondensates of phenols, in particular resols, and (b) furan derivatives and/or furfuryl alcohol or precondensates of furan derivatives and/or furfuryl alcohol. As a result, phenol/furfuryl alcohol/formaldehyde resin-bonded mold materials are formed during curing. Preference is thus given according to the invention to the binder system being curable to give a phenol/furfuryl alcohol/formaldehyde resin, particularly preferably curable to give a high-polymer and solid phenol/furfuryl alcohol/formaldehyde resin. Curing of these systems is, according to the invention, preferably effected by addition of a hardener, where the hardener is an organic or inorganic acid, particularly preferably an aromatic sulfonic acid (in particular para-toluenesulfonic or xylenesulfonic acid or mixtures of para-toluenesulfonic and xylenesulfonic acid), phosphoric acid, methanesulfonic acid, sulfuric acid, one or more carboxylic acids or mixtures of the abovementioned acids.

Particular preference is given to mold material mixtures according to the invention in which the binder additionally comprises furan derivatives and/or furfuryl alcohol or precondensates of furan derivatives and/or furfuryl alcohol. As a result, furfuryl alcohol/formaldehyde resin-bonded mold materials are formed during curing. Preference is thus given according to the invention to the binder system being curable to give a furfuryl alcohol/formaldehyde resin, preferably curable to give a high-polymer and solid furfuryl alcohol/formaldehyde resin.

Particular preference is given to mold material mixtures according to the invention in which the binder additionally comprises urea or urea derivatives or precondensates of urea or urea derivatives. This results in formation of urea/formaldehyde resin-bonded mold materials during curing. Preference is thus given according to the invention to the binder system being curable to give a urea/formaldehyde resin, preferably curable to give a high-polymer and solid urea/ formaldehyde resin. According to the invention, curing of these systems is preferably effected by heating in the presence of a latent hardener (warm box) or by addition of a hardener, where the hardener is an organic or inorganic acid, particularly preferably an aromatic sulfonic acid (in particular para-toluenesulfonic or xylenesulfonic acid or mixtures of para-toluenesulfonic and xylenesulfonic acid), phosphoric acid, methanesulfonic acid, sulfuric acid, one or more carboxylic acids or mixtures of the abovementioned acids.

Particular preference is given to mold material mixtures according to the invention in which the binder additionally comprises i) urea or urea derivatives or precondensates of urea or urea derivatives and ii) furan derivatives and/or furfuryl alcohol or precondensates of furan derivatives and/or furfuryl alcohol. This results in formation of urea/furfuryl alcohol/formaldehyde resin-bonded mold materials during curing. Preference is thus given, according to the invention, to the binder system being curable to give a urea/furfuryl alcohol/formaldehyde resin, preferably curable to give a high-polymer and solid urea/furfuryl alcohol/formaldehyde resin. According to the invention, curing of these systems is preferably effected by heating in the presence of a latent hardener (warm box) or by addition of a hardener, where the hardener is an organic or inorganic acid, particularly preferably an aromatic sulfonic acid (in particular para-toluenesulfonic or xylenesulfonic acid or mixtures of para-toluenesulfonic and xylenesulfonic acid), phosphoric acid, methanesulfonic acid, sulfuric acid, one or more carboxylic acids or mixtures of the abovementioned acids.

Particular preference is given to mold material mixtures according to the invention in which the binder additionally comprises i) urea or urea derivatives or precondensates of urea or urea derivatives, ii) furan derivatives and/or furfuryl alcohol or precondensates of furan derivatives and/or furfuryl alcohol and iii) phenols, in particular phenol, o-cresol, p-cresol, 3,5-xylenol or resorcinol, or precondensates of phenols, in particular resols. This results in formation of urea/furfuryl alcohol/phenol/formaldehyde resin-bonded mold materials during curing. Preference is thus given, according to the invention, to the binder system being curable to give a urea/furfuryl alcohol/phenol/formaldehyde resin, preferably curable to give a high-polymer and solid urea/furfuryl alcohol/phenol/formaldehyde resin. According to the invention, curing of these systems is preferably effected by heating in the presence of a latent hardener (warm box) or by addition of a hardener, where the hardener is an organic or inorganic acid, particularly preferably an aromatic sulfonic acid (in particular para-toluenesulfonic or xylenesulfonic acid or mixtures of para-toluenesulfonic and xylenesulfonic acid), phosphoric acid, methanesulfonic acid, sulfuric acid, one or more carboxylic acids or mixtures of the abovementioned acids.

Preference is therefore given, according to the invention, to mold material mixtures in which the binder system is curable to give a i) phenol/furfuryl alcohol/formaldehyde resin,
ii) furfuryl alcohol/formaldehyde resin,
iii) urea/formaldehyde resin,
iv) urea/furfuryl alcohol/formaldehyde resin
or
v) urea/furfuryl alcohol/phenol/formaldehyde resin.

Preference is given to mold material mixtures according to the invention in which the amino acid is selected from the group consisting of alanine, glycine, isoleucine, methionine, proline, valine, histidine, phenylalanine, tryptophan, tyrosine, asparagine, glutamine, cysteine, methionine, serine, threonine, tyrosine, lysine, arginine and histidine, preferably selected from the group consisting of glycine, glutamine, alanine, valine and serine.

Our own studies have shown that the amino acids glycine, glutamine, alanine, valine and serine in particular display good properties when used in mold material mixtures of the invention. The strength of the moldings produced from the mold material mixtures can be improved particularly well by the addition of these amino acids without other properties of the moldings produced or of the mold material mixture being impaired. In addition, the content of free formaldehyde in the mold material mixture and in the moldings produced from the mold material mixture can be reduced. Among the amino acids, glycine is particularly preferred.

Preference is given to mold material mixtures according to the invention in which the amino acid is an α-amino acid.

Preference is likewise given to a mold material mixture according to the invention in which the proportion of all amino acids in the mold material mixture is from 0.005 to 5.0% by weight, preferably from 0.01 to 2.0% by weight, particularly preferably from 0.03 to 1.0% by weight, based on the solids content of the total mold material mixture.

It has been found in our own studies that mold material mixtures according to the invention have particularly good properties when the proportion of all amino acids in the mold material mixture is in the abovementioned ranges. When the proportions of amino acids in the mold material mixture are too low, it is possible for the strength of the moldings produced from the mold material mixtures not to be improved sufficiently and/or for the amount of free formaldehyde not to be reduced. In the case of excessively high proportions of amino acids, no further improvement in the properties is observed.

Preference is likewise given to a mold material mixture according to the invention in which the molar ratio of all amino acids to available formaldehyde is from 4:1 to 1:0.5, preferably from 3:1 to 1:0.9, particularly preferably from 2.5:1 to 1:1.

In our own studies, it has been found that mold material mixtures according to the invention have particularly good properties when the molar ratio of all amino acids to available formaldehyde is in the ranges indicated above. In particular, the strength of the moldings produced from the mold material mixtures and the proportion of free formaldehyde in the mold material mixtures or the moldings produced therefrom display particularly good properties when the ranges indicated are adhered to.

Preference is likewise given to a mold material mixture according to the invention in which the formaldehyde donors and/or precondensates of formaldehyde are selected from the group consisting of paraformaldehyde, hexamethylenetetramine, trioxane, methylolamine and methylolamine derivatives such as trimethylolmelamine or hexamethylolmelamine.

In a preferred embodiment of the present invention, the mold material mixture does not contain any proteins or peptides, for example dipeptides, tripeptides, tetrapeptides, pentapeptides or higher peptides. It has likewise been found that some embodiments of the present invention have advantages when not aspartic acid but instead another amino acid, preferably glycine, glutamine, alanine, valine and/or serine, is used as amino acid.

A further aspect of the present invention provides moldings for the foundry industry produced using a mold material mixture according to the invention.

Preference is likewise given to a molding according to the invention in which the one or the several pourable, refractive fillers are bound by a cured binder and the cured binder is a i) phenol/furfuryl alcohol/formaldehyde resin,
ii) furfuryl alcohol/formaldehyde resin,
iii) urea/formaldehyde resin,
iv) urea/furfuryl alcohol/formaldehyde resin
or
v) urea/furfuryl alcohol/phenol/formaldehyde resin.

Preference is given to a molding according to the invention in which the molding is formed by curing of the binder system, with a chemical reaction taking place between formaldehyde and/or a precondensate of formaldehyde and (a) phenols, in particular phenol, o-cresol, p-cresol, 3,5-xylenol or resorcinol, or precondensates of phenols, in particular resols,
(b) furan derivatives and/or furfuryl alcohol or precondensates of furan derivatives and/or furfuryl alcohol
and/or
(c) urea or urea derivatives or precondensates of urea or urea derivatives.

A further aspect of the present invention provides for the use of amino acids (a) in a mold material mixture for producing moldings for the foundry industry or (b) for producing moldings for the foundry industry.

A further aspect of the present invention provides for the use of at least one amino acid in a mold material mixture for the foundry industry, wherein the mold material mixture contains formaldehyde or a formaldehyde source in addition to the amino acid. Preference is here given to the amino acid being selected from the group consisting of alanine, glycine, isoleucine, methionine, proline, valine, histidine, phenylalanine, tryptophan, tyrosine, asparagine, glutamine, cysteine, methionine, serine, threonine, tyrosine, lysine, arginine and histidine, particularly preferably selected from the group consisting of glycine, glutamine, alanine, valine and serine.

A further aspect of the present invention provides for the use of at least one amino acid for producing moldings having improved strength and/or a reduced tendency to produce casting defects.

A further aspect of the present invention provides for the use of mold material mixtures according to the invention for producing moldings for the foundry industry.

A further aspect in the context of the present invention relates to a process for producing a mold material mixture according to the invention, which comprises the following steps:

a) production or provision of one or more pourable, refractory fillers,
b) production or provision of a binder system comprising
   i) formaldehyde, a formaldehyde donor and/or precondensates of formaldehyde,
   and
   ii) an amino acid
and
c) mixing of all components.

A further aspect in the context of the present invention relates to a process for producing a molding for the foundry industry, which comprises the following steps:

i) production or provision of a mold material mixture according to the invention, preferably by means of a process according to the invention for the of a mold material mixture according to the invention,
ii) shaping of the mold material mixture to give an uncured molding
and
iii) curing the uncured molding or allowing the latter to cure, so that a molding for the foundry industry results.

In a preferred embodiment of the process of the invention for producing a molding for the foundry industry, the curing or the allowing-to-cure of the uncured molding is effected by heating.

In an alternative preferred embodiment of the process of the invention for producing a molding for the foundry industry, the curing or the allowing-to-cure is effected by addition of a hardener during the production or provision of the mold material mixture according to the invention. The hardener is preferably an organic or inorganic acid, particularly preferably a sulfonic acid (in particular para-toluenesulfonic acid), phosphoric acid, methanesulfonic acid, carboxylic acid and/or sulfuric acid or a mixture thereof.

A further aspect in the context of the present invention relates to a kit for producing a mold material mixture according to the invention and/or for producing a molding according to the invention for the foundry industry, preferably for producing feeders, foundry molds or cores for the foundry industry, which comprises I) a binder system as defined above for a mold material mixture according to the invention,
II) optionally one or more pourable, refractory fillers and
III) optionally a hardener, preferably an organic or inorganic acid, particularly preferably an aromatic sulfonic acid (in particular para-toluenesulfonic acid), phosphoric acid, carboxylic acid, methanesulfonic acid and/or sulfuric acid or a mixture thereof.

In the context of the present invention, a plurality of the aspects indicated above as being preferred are preferably realized at the same time; particular preference is given to the combinations of such aspects and the corresponding features which can be derived from the accompanying claims.

The present invention will be illustrated below with the aid of selected examples.

EXAMPLES

Example 1 (According to the Invention)

Production of a Binder System:

0.43 g of glycine (5.7 mmol) was added to 100 g of a commercial phenol-furan cold-cure resin from Hüttenes-Albertus with the designation XA20 (furfuryl alcohol: 78%, free phenol: 4.5%, water content: 2%, free formaldehyde content: 0.171% (corresponding to 5.7 mmol); obtainable from Hüttenes-Albertus Chemische Werke GmbH) at a temperature of 40° C. and the mixture was stirred for 60 minutes. After cooling the binder system to room temperature (18-22° C.), the binder system had a content of free formaldehyde of 0.09%.

Production of a Mold Material Mixture:

At room temperature (18-22° C.) and a relative atmospheric humidity (RAH) of 40-55%, 100 parts by weight of silica sand H32 (Quarzwerke Frechen) were placed in a laboratory mixer (BOSCH), admixed with 0.5 part by weight of hardener (Aktivator 100 SR; para-toluenesulfonic acid 65%, <0.5% of $H_2SO_4$) and mixed for 30 seconds. 1.0 part by weight of the binder system produced was subsequently added and the mixture was mixed for a further 45 seconds. The temperature of the mold material mixture produced was 18-22° C.

Production of (Test) Moldings:

The mold material mixture was subsequently introduced manually into a test bar mold and compacted by means of a hand plate. Cuboidal test bars having the dimensions 220 mm×22.36 mm×22.36 mm, known as Georg-Fischer test bars, were produced as test specimens.

Determination of the Processing Time (PT) and Curing Time (CT):

To determine the processing time (PT) and curing time (CT) of the mold material mixture, the setting behavior was observed on a Georg-Fischer test bar using the testing pin in accordance with the VDG leaflet P 72.

Determination of the Bending Strength Value:

The respective bending strength values were determined in accordance with the VDG leaflet P 72. To determine the bending strengths, the test bars were placed in a Georg-Fischer strength testing apparatus equipped with a three-point bending device (DISA-Industrie AG, Schaffhausen, CH) and the force which led to fracture of the test bars was measured.

The bending strengths were measured after one hour, after two hours, after four hours and after 24 hours after production of the (test) moldings to be tested (storage of the cores after demolding in each case at room temperature 18-22° C., relative atmospheric humidity (20-55%)).

The values determined are summarized in table 1.

The (test) moldings according to the invention produced from the mold material mixture according to the invention display an improved bending strength compared to the (test) moldings produced in comparative examples 1 and 2 after 24 hours without the setting behavior being adversely affected. In addition, the content of free formaldehyde in the binder system according to the invention is lower than the content of free formaldehyde in the binder systems as per comparative examples 1 and 2.

Example 2 (According to the Invention)

The production of the binder system, the mold material mixture and the (test) moldings was carried out in a manner analogous to example 1. However, 5.7 mmol of alanine were used instead of glycine.

After cooling the binder system to room temperature (18-22° C.), the binder system had a content of free formaldehyde of 0.08%.

Example 3 (According to the Invention)

The production of the binder system, the mold material mixture and the (test) moldings was carried out in a manner analogous to example 1. However, 5.7 mmol of serine were used instead of glycine.

After cooling the binder system to room temperature (18-22° C.), the binder system had a content of free formaldehyde of 0.09%.

Example 4 (According to the Invention)

The production of the binder system, the mold material mixture and the (test) moldings was carried out in a manner analogous to example 1. However, 5.7 mmol of valine were used instead of glycine.

After cooling the binder system to room temperature (18-22° C.), the binder system had a content of free formaldehyde of 0.09%.

Comparative Example 1 (not According to the Invention)

The production of the binder system, the mold material mixture and the (test) moldings was carried out in a manner analogous to example 1. However, 5.7 mmol of urea were used instead of the glycine.

After cooling the binder system to room temperature (18-22° C.), the binder system had a content of free formaldehyde of 0.13%.

Comparative Example 2 (not According to the Invention)

The production of the binder system, the mold material mixture and the (test) moldings was carried out in a manner analogous to example 1. However, no glycine was added.

After cooling the binder system to room temperature (18-22° C.), the binder system had a content of free formaldehyde of 0.15%.

Example 5 (According to the Invention)

The production of the binder system, the mold material mixture and the (test) moldings was carried out in a manner analogous to example 1. However, 100 g of a commercial phenol-furan cold-cure resin from Hüttenes-Albertus having the designation Kaltharz 7864 (furfuryl alcohol: 40%, free phenol: 4%, water content: 2%, free formaldehyde content: 0.125% (corresponding to 4.2 mmol); obtainable from Hüttenes-Albertus Chemische Werke GmbH) were used instead of the phenol-furan cold-cure resin having the designation XA20 used in example 1. However, 4.2 mmol of glycine were used.

After cooling the binder system to room temperature (18-22° C.), the binder system had a content of free formaldehyde of 0.04%.

The values determined are summarized in table 1.

The (test) moldings according to the invention produced from the mold material mixture according to the invention display an improved bending strength compared to the (test) moldings produced in comparative examples 3 and 4 after four hours without the setting behavior being adversely affected. In addition, the content of free formaldehyde in the binder system according to the invention is lower than the content of free formaldehyde in the binder systems as per comparative examples 3 and 4.

Example 6 (According to the Invention)

The production of the binder system, the mold material mixture and the (test) moldings was carried out in a manner analogous to example 5. However, 4.2 mmol of alanine were used instead of glycine.

After cooling the binder system to room temperature (18-22° C.), the binder system had a content of free formaldehyde of 0.05%.

Example 7 (According to the Invention)

The production of the binder system, the mold material mixture and the (test) moldings was carried out in a manner analogous to example 5. However, 4.2 mmol of serine were used instead of glycine.

After cooling the binder system to room temperature (18-22° C.), the binder system had a content of free formaldehyde of 0.06%.

Example 8 (According to the Invention)

The production of the binder system, the mold material mixture and the (test) moldings was carried out in a manner analogous to example 5. However, 4.2 mmol of valine were used instead of glycine.

After cooling the binder system to room temperature (18-22° C.), the binder system had a content of free formaldehyde of 0.05%.

Example 9 (According to the Invention)

The production of the binder system, the mold material mixture and the (test) moldings was carried out in a manner analogous to example 5. However, 4.2 mmol of glutamine were used instead of glycine.

After cooling the binder system to room temperature (18-22° C.), the binder system had a content of free formaldehyde of 0.03%.

Comparative Example 3 (not According to the Invention)

The production of the binder system, the mold material mixture and the (test) moldings was carried out in a manner analogous to example 5. However, 4.2 mmol of urea were used instead of the glycine.

After cooling the binder system to room temperature (18-22° C.), the binder system had a content of free formaldehyde of 0.12%.

Comparative Example 4 (not According to the Invention)

The production of the binder system, the mold material mixture and the (test) moldings was carried out in a manner analogous to example 5. However, no glycine was added.

After cooling the binder system to room temperature (18-22° C.), the binder system had a content of free formaldehyde of 0.17%.

Example 10 (According to the Invention)

The production of the binder system, the mold material mixture and the (test) moldings was carried out in a manner analogous to example 1. However, 100 g of a commercial phenol-furan cold-cure resin from Hüttenes-Albertus having the designation Kaltharz 8117 (furfuryl alcohol: 50%, free phenol: 3-4%, water content: 2%, free formaldehyde content: 0.120% (corresponding to 4 mmol); obtainable from Hüttenes-Albertus Chemische Werke GmbH) were used instead of the phenol-furan cold-cure resin having the designation XA20 used in example 1. However, 4.0 mmol of glycine were used.

After cooling the binder system to room temperature (18-22° C.), the binder system had a content of free formaldehyde of 0.05%.

The values determined are summarized in table 1.

The (test) moldings according to the invention produced from the mold material mixture according to the invention display an improved bending strength compared to the (test) moldings produced in comparative examples 5 and 6 after 24 hours without the setting behavior being adversely affected. In addition, the content of free formaldehyde in the binder system according to the invention is lower than the content of free formaldehyde in the binder systems as per comparative examples 6 and 5.

Example 11 (According to the Invention)

The production of the binder system, the mold material mixture and the (test) moldings was carried out in a manner analogous to example 10. However, 4.0 mmol of alanine were used instead of glycine.

After cooling the binder system to room temperature (18-22° C.), the binder system had a content of free formaldehyde of 0.05%.

Example 12 (According to the Invention)

The production of the binder system, the mold material mixture and the (test) moldings was carried out in a manner analogous to example 10. However, 4.0 mmol of serine were used instead of glycine.

After cooling the binder system to room temperature (18-22° C.), the binder system had a content of free formaldehyde of 0.08%.

Example 13 (According to the Invention)

The production of the binder system, the mold material mixture and the (test) moldings was carried out in a manner analogous to example 10. However, 4.0 mmol of valine were used instead of glycine.

After cooling the binder system to room temperature (18-22° C.), the binder system had a content of free formaldehyde of 0.07%.

Example 14 (According to the Invention)

The production of the binder system, the mold material mixture and the (test) moldings was carried out in a manner analogous to example 10. However, 4.0 mmol of glutamine were used instead of glycine.

After cooling the binder system to room temperature (18-22° C.), the binder system had a content of free formaldehyde of 0.03%.

Comparative Example 5 (not According to the Invention)

The production of the binder system, the mold material mixture and the (test) moldings was carried out in a manner analogous to example 10. However, 4.0 mmol of urea were used instead of the glycine.

After cooling the binder system to room temperature (18-22° C.), the binder system had a content of free formaldehyde of 0.05%.

Comparative Example 6 (not According to the Invention)

The production of the binder system, the mold material mixture and the (test) moldings was carried out in a manner analogous to example 10. However, no glycine was added.

After cooling the binder system to room temperature (18-22° C.), the binder system had a content of free formaldehyde of 0.15%.

Example 15 (According to the Invention)

The production of the binder system, the mold material mixture and the (test) moldings was carried out in a manner analogous to example 1. However, 100 g of a commercial phenol-furan cold-cure resin from Hüttenes-Albertus having the designation Kaltharz 8500 (furfuryl alcohol: 57%, free phenol: 1.1-1.8%, water content: 8-10%, free formaldehyde content: 0.25% (corresponding to 8.3 mmol); obtainable from Hüttenes-Albertus Chemische Werke GmbH) were used instead of the phenol-furan cold-cure resin having the designation XA20 used in example 1. However, 8.3 mmol of glycine were used.

After cooling the binder system to room temperature (18-22° C.), the binder system had a content of free formaldehyde of 0.04%.

The values determined are summarized in table 1.

The (test) moldings according to the invention produced from the mold material mixture according to the invention display an improved bending strength compared to the (test) moldings produced in comparative examples 7 and 8 after 24 hours without the setting behavior being adversely affected. In addition, the content of free formaldehyde in the binder system according to the invention is lower than the content of free formaldehyde in the binder systems as per comparative examples 7 and 8.

Example 16 (According to the Invention)

The production of the binder system, the mold material mixture and the (test) moldings was carried out in a manner analogous to example 15. However, 8.3 mmol of alanine were used instead of glycine.

After cooling the binder system to room temperature (18-22° C.), the binder system had a content of free formaldehyde of 0.04%.

Example 17 (According to the Invention)

The production of the binder system, the mold material mixture and the (test) moldings was carried out in a manner analogous to example 15. However, 8.3 mmol of serine were used instead of glycine.

After cooling the binder system to room temperature (18-22° C.), the binder system had a content of free formaldehyde of 0.05%.

Example 18 (According to the Invention)

The production of the binder system, the mold material mixture and the (test) moldings was carried out in a manner analogous to example 15. However, 8.3 mmol of valine were used instead of glycine.

After cooling the binder system to room temperature (18-22° C.), the binder system had a content of free formaldehyde of 0.07%.

Example 19 (According to the Invention)

The production of the binder system, the mold material mixture and the (test) moldings was carried out in a manner analogous to example 15. However, 8.3 mmol of glutamine were used instead of glycine.

After cooling the binder system to room temperature (18-22° C.), the binder system had a content of free formaldehyde of 0.06%.

Comparative Example 7 (not According to the Invention)

The production of the binder system, the mold material mixture and the (test) moldings was carried out in a manner analogous to example 15. However, 8.3 mmol of urea were used instead of the glycine.

After cooling the binder system to room temperature (18-22° C.), the binder system had a content of free formaldehyde of 0.19%.

Comparative Example 8 (not According to the Invention)

The production of the binder system, the mold material mixture and the (test) moldings was carried out in a manner analogous to example 15. However, no glycine was added.

After cooling the binder system to room temperature (18-22° C.), the binder system had a content of free formaldehyde of 0.27%.

Example 20 (According to the Invention)

The production of the binder system, the mold material mixture and the (test) moldings was carried out in a manner analogous to example 1. However, 100 g of a commercial furan cold-cure resin from Hüttenes-Albertus having the designation Kaltharz TDE 20 (furfuryl alcohol: 70%, water content: 5-7%, free formaldehyde content: 0.23% (corresponding to 7.7 mmol); obtainable from Hüttenes-Albertus Chemische Werke GmbH) were used instead of the phenol-furan cold-cure resin having the designation XA20 used in example 1. However, 7.7 mmol of glycine were used.

After cooling the binder system to room temperature (18-22° C.), the binder system had a content of free formaldehyde of 0.09%.

The values determined are summarized in table 1.

The (test) moldings according to the invention produced from the mold material mixture according to the invention display an improved bending strength compared to the (test) moldings produced in comparative example 9 after 24 hours without the setting behavior being adversely affected. In addition, the content of free formaldehyde in the binder system according to the invention is lower than the content of free formaldehyde in the binder systems as per comparative example 9.

Example 21 (According to the Invention)

The production of the binder system, the mold material mixture and the (test) moldings was carried out in a manner analogous to example 20. However, 7.7 mmol of alanine were used instead of glycine.

After cooling the binder system to room temperature (18-22° C.), the binder system had a content of free formaldehyde of 0.08%.

Example 22 (According to the Invention)

The production of the binder system, the mold material mixture and the (test) moldings was carried out in a manner analogous to example 20. However, 7.7 mmol of serine were used instead of glycine.

After cooling the binder system to room temperature (18-22° C.), the binder system had a content of free formaldehyde of 0.09%.

Example 23 (According to the Invention)

The production of the binder system, the mold material mixture and the (test) moldings was carried out in a manner analogous to example 20. However, 7.7 mmol of valine were used instead of glycine.

After cooling the binder system to room temperature (18-22° C.), the binder system had a content of free formaldehyde of 0.07%.

Comparative Example 9 (not According to the Invention)

The production of the binder system, the mold material mixture and the (test) moldings was carried out in a manner analogous to example 20. However, no glycine was added.

After cooling the binder system to room temperature (18-22° C.), the binder system had a content of free formaldehyde of 0.23%.

Example 24 (According to the Invention)

Production of a Binder System:

0.62 g of glycine (8.3 mmol) was added to 100 g of a commercial phenol-furan warm box resin from Hüttenes-Albertus having the designation "Furesan 7682" (furfuryl alcohol: 57%, free phenol: 1.0-1.6%, water content: 8-10%, free formaldehyde content: 0.25% (corresponding to 8.3 mmol); obtainable from Hüttenes-Albertus Chemische Werke GmbH) at a temperature of 40° C. and stirred for 60 minutes. After cooling the binder system to room temperature (18-22° C.), the binder system had a content of free formaldehyde of 0.07%.

Production of a Mold Material Mixture:

At room temperature (18-22° C.) and a relative atmospheric humidity (40-55%), 100 parts by weight of silica sand H32 are placed in a laboratory mixer (BOSCH), admixed with 0.3% of hardener (Furedur 2) and the mixture is mixed for 15 seconds. The sand/hardener mixture is subsequently provided with 1.5 parts by weight of resin and mixed for a further 150 seconds. The temperature of the mold material mixture produced is 18-22° C.

Production of (Test) Moldings:

The mold material mixture was subsequently introduced by hand into a test bar mold, compacted using a hand plate and cured at 220° C. Cuboidal test bars having the dimensions 220 mm×22.36 mm×22.36 mm, known as Georg-Fischer test bars, were produced as test specimens.

Various test moldings were produced and these were cured for 15, 30, 60 or 120 seconds at 220° C.

The hot bending strength (bending strength immediately after demolding of the hot (test) molding) and the cold bending strength (bending strength of the cooled (test) molding after 24 hours) were determined on the (test) moldings produced in accordance with the method of determination described in example 1.

The results are summarized in table 2.

The cold bending strength of the (test) molding produced is higher than in the case of comparative example 11 in which no amino acid was added. In the case of the specimens having a short baking time (15 and 30 seconds), the cold bending strength is particularly high. The hot bending strengths are not adversely affected.

These results are particularly surprising since it has hitherto been assumed in the case of phenol-furan warm box resins that high bending strengths (in particular at short baking times) can be achieved only when there is a high content of free formaldehyde.

Example 25 (According to the Invention)

The production of the binder system, the mold material mixture and the (test) moldings was carried out in a manner analogous to example 24. However, 8.3 mmol of alanine were used instead of glycine.

After cooling the binder system to room temperature (18-22° C.), the binder system had a content of free formaldehyde of below 0.08%.

The results are summarized in table 2.

The cold bending strength of the (test) molding produced is higher than in the case of comparative example 11 in which no amino acid was added. In the case of the specimens having a short baking time (15 and 30 seconds), the cold bending strength is particularly high. The hot bending strengths are not adversely affected.

These results are particularly surprising since it has hitherto been assumed in the case of phenol-furan warm box resins that high bending strengths (in particular at short baking times) can be achieved only when there is a high content of free formaldehyde.

Example 26 (According to the Invention)

The production of the binder system, the mold material mixture and the (test) moldings was carried out in a manner analogous to example 24. However, 8.3 mmol of glutamine were used instead of glycine.

After cooling the binder system to room temperature (18-22° C.), the binder system had a content of free formaldehyde of below 0.08%.

The results are summarized in table 2.

The cold bending strength of the (test) molding produced is higher than in the case of comparative example 11 in which no amino acid was added. In the case of the specimens having a short baking time (15 and 30 seconds), the cold bending strength is particularly high. The hot bending strengths are not adversely affected.

These results are particularly surprising since it has hitherto been assumed in the case of phenol-furan warm box resins that high bending strengths (in particular at short baking times) can be achieved only when there is a high content of free formaldehyde.

Example 27 (According to the Invention)

The production of the binder system, the mold material mixture and the (test) moldings was carried out in a manner analogous to example 24. However, 8.3 mmol of serine were used instead of glycine.

After cooling the binder system to room temperature (18-22° C.), the binder system had a content of free formaldehyde of below 0.08%.

Comparative Example 10 (not According to the Invention)

The production of the binder system, the mold material mixture and the (test) moldings was carried out in a manner analogous to example 24. However, 8.3 mmol of urea were used instead of the glycine.

After cooling the binder system to room temperature (18-22° C.), the binder system had a content of free formaldehyde of 0.07%.

Comparative Example 11 (not According to the Invention)

The production of the binder system, the mold material mixture and the (test) moldings was carried out in a manner analogous to example 24. However, no glycine was added.

After cooling the binder system to room temperature (18-22° C.), the binder system had a content of free formaldehyde of 0.18%.

Results:

TABLE 1

Comparison of the processing time (PT) and curing time (CT) and also the bending strengths of the (test) moldings produced in examples 1 to 23 and comparative examples 1 to 9.

| Example | Additive | PT [min] | CT [min] | Bending strengths after xx hours in [N/cm$^2$] 1 h | 2 h | 4 h | 24 h |
|---|---|---|---|---|---|---|---|
| Example 1 | Glycine | 7 | 11 | 250 | 300 | 380 | 460 |
| Example 2 | Alanine | 9 | 12 | 220 | 300 | 360 | 430 |
| Example 3 | Serine | 6 | 9 | 210 | 270 | 370 | 430 |
| Example 4 | Valine | 7 | 10 | 230 | 300 | 370 | 440 |
| Comparative example 1 | Urea | 17 | 27 | 55 | 165 | 185 | 200 |
| Comparative example 2 | No additive | 9 | 12 | 260 | 310 | 350 | 390 |
| Example 5 | Glycine | 14 | 20 | 140 | 240 | 360 | 380 |
| Example 6 | Alanine | 13 | 20 | 110 | 210 | 300 | 370 |
| Example 7 | Serine | 11 | 18 | 170 | 250 | 320 | 380 |
| Example 8 | Valine | 14 | 22 | 130 | 220 | 350 | 360 |
| Example 9 | Glutamine | 14 | 19 | 80 | 200 | 330 | 350 |
| Comparative example 3 | Urea | 20 | 32 | 60 | 140 | 230 | 290 |
| Comparative example 4 | No additive | 12 | 17 | 150 | 240 | 290 | 340 |
| Example 10 | Glycine | 13 | 19 | 170 | 310 | 370 | 390 |
| Example 11 | Alanine | 11 | 17 | 170 | 300 | 360 | 390 |
| Example 12 | Serine | 10 | 17 | 190 | 310 | 370 | 380 |
| Example 13 | Valine | 9 | 16 | 220 | 330 | 360 | 400 |
| Example 14 | Glutamine | 11 | 16 | 160 | 390 | 360 | 390 |
| Comparative example 5 | Urea | 18 | 28 | 45 | 175 | 205 | 256 |
| Comparative example 6 | No additive | 11 | 18 | 130 | 240 | 340 | 350 |
| Example 15 | Glycine | 7 | 10 | 210 | 320 | 400 | 480 |
| Example 16 | Alanine | 9 | 13 | 180 | 310 | 390 | 450 |
| Example 17 | Serine | 6 | 9 | 180 | 310 | 390 | 430 |
| Example 18 | Valine | 6 | 10 | 200 | 320 | 400 | 440 |
| Example 19 | Glutamine | 6 | 9 | 190 | 310 | 360 | 450 |
| Comparative example 7 | Urea | 9 | 14 | 125 | 295 | 340 | 370 |
| Comparative example 8 | No additive | 5 | 9 | 230 | 280 | 350 | 400 |
| Example 20 | Glycine | 15 | 19 | 160 | 260 | 370 | 440 |
| Example 21 | Alanine | 14 | 18 | 140 | 210 | 360 | 440 |
| Example 22 | Serine | 12 | 18 | 170 | 220 | 400 | 430 |
| Example 23 | Valine | 12 | 18 | 120 | 250 | 360 | 420 |
| Comparative example 9 | No additive | 12 | 18 | 120 | 250 | 340 | 400 |

The invention claimed is:

1. A mold material mixture for producing moldings for the foundry industry, which comprises A) one or more pourable, refractory fillers, B) a no-bake binder system comprising i) formaldehyde, a formaldehyde donor and/or precondensates of formaldehyde, and furan derivatives and/or furfuryl alcohol or precondensates of furan derivatives and/or furfuryl alcohol; and ii) an amino acid selected from the group consisting of glycine, glutamine, alanine, valine, and serine, wherein the molar ratio of amino acid to free formaldehyde is from 4:1 to 1:0.5.

2. The mold material mixture as claimed in claim 1, wherein the amino acid is glycine.

3. The mold material mixture as claimed in claim 1, wherein the one or more pourable, refractory fillers are selected from the group consisting of silica sand, fused silica sand, olivine sand, chrome-magnesite granules, aluminum silicates, heavy minerals, industrial ceramics, feldspar-containing sands, andalusite sands, hollow α-alumina spheres, spheres composed of fly ashes, rice hull ashes, expanded glasses, foamed glasses, expanded perlites, core-shell particles, and fly ashes.

4. The mold material mixture as claimed in claim 3, wherein the aluminum silicate is J-sand;

the heavy minerals are selected from the group consisting of chromite, zircon sand, and R-sand; and the industrial ceramics are selected from the group consisting of chamotte, M-sand, bauxite sand and silicon carbide.

5. The mold material mixture as claimed in claim 1, wherein the one or more pourable, refractory fillers have an average particle diameter d50 in the range from 0.001 to 5 mm.

6. The mold material mixture as claimed in claim 5, wherein the one, at least one of the several or all pourable, refractory fillers have an average particle diameter d50 in the range from 0.01 to 3 mm.

7. The mold material mixture as claimed in claim 1, wherein the ratio of the total mass of the one or more pourable, refractory fillers to the total mass of constituents of the no-bake binder system of the mold material mixture is in the range from 100:5 to 100:0.1.

8. The mold material mixture as claimed in claim 7, wherein the ratio of the total mass of pourable, refractory fillers to the total mass of constituents of the binder system of the mold material mixture is in the range from 100:3 to 100:0.4.

TABLE 2

Comparison of the hot bending strengths and cold bending strengths of the (test) moldings produced in examples 24 to 26 and in comparative example 11.

| | Hot bending strengths in [N/cm$^2$]-tested immediately after production after . . . seconds baking time at 220° C. | | | | Cold bending strengths [N/cm$^2$]-tested after cooling of the cores after . . . seconds baking time at 220° C. | | | |
|---|---|---|---|---|---|---|---|---|
| | 15" | 30" | 60" | 120" | 15" | 30" | 60" | 120" |
| Comparative example 11 | 210 | 225 | 235 | 220 | 680 | 660 | 600 | 530 |
| Example 24 | 215 | 220 | 240 | 230 | 740 | 710 | 630 | 580 |
| Example 25 | 230 | 240 | 280 | 220 | 770 | 760 | 610 | 570 |
| Example 26 | 200 | 220 | 270 | 220 | 780 | 740 | 610 | 550 |

9. The mold material mixture as claimed in claim 1, wherein the no-bake binder system is curable to give a i) phenol/furfuryl alcohol/formaldehyde resin, ii) furfuryl alcohol/formaldehyde resin, iii) urea/furfuryl alcohol/formaldehyde resin or iv) urea/furfuryl alcohol/phenol/formaldehyde resin.

10. The mold material mixture as claimed in claim 1, wherein the proportion of the amino acid in the mold material mixture is from 0.005 to 2% by weight based on the solids content of the total mold material mixture.

11. The mold material mixture as claimed in claim 10, wherein the proportion of the amino acid in the mold material mixture is from 0.01 to 1% by weight.

12. The mold material mixture as claimed in claim 1, wherein the molar ratio of amino acid to free formaldehyde is from 3:1 to 1:0.9.

13. A process for producing a mold material mixture as claimed in claim 1, which comprises the following steps:

a) production or provision of one or more pourable, refractory fillers, b) production or provision of a no-bake binder system comprising i) formaldehyde, a formaldehyde donor and/or precondensates of formaldehyde, and furan derivatives and/or furfuryl alcohol or precondensates of furan derivatives and/or furfuryl alcohol; and ii) an amino acid selected from the group consisting of glycine, glutamine, alanine, valine, and serine, wherein the molar ratio of amino acid to free formaldehyde is from 4:1 to 1:0.5;

and c) mixing of all components.

14. A molding for the foundry industry produced using a mold material mixture as defined in claim 1.

15. A process for producing a molding for the foundry industry, which comprises the following steps:

i) production or provision of a mold material mixture as claimed in claim 1, ii) shaping of the mold material mixture to give an uncured molding and iii) curing the uncured molding or allowing the latter to cure, so that a molding for the foundry industry results, wherein the curing is effected without heating by addition of a hardener during production or provision of the mold material mixture, wherein the hardener is an organic or inorganic acid.

16. A kit for producing a mold material mixture and/or for producing a molding, the kit comprising:

I) a no bake binder system comprising, i) formaldehyde, a formaldehyde donor and/or precondensates of formaldehyde, and furan derivatives and/or furfuryl alcohol or precondensates of furan derivatives and/or furfuryl alcohol; and ii) an amino acid selected from the group consisting of glycine, glutamine, alanine, valine, and serine, wherein the molar ratio of amino acid to free formaldehyde is from 4:1 to 1:0.5;

and

II) a hardener, wherein the hardener is selected from the group consisting of a sulfonic acid, phosphoric acid, carboxylic acid, methanesulfonic acid and sulfuric acid and mixtures thereof and III) optionally one or more pourable, refractory fillers.

17. The kit as claimed in claim 16, wherein the hardener is a sulfonic acid, wherein the sulfonic acid is para-toluenesulfonic acid.

* * * * *